US011745059B2

(12) United States Patent
Sakakura

(10) Patent No.: US 11,745,059 B2
(45) Date of Patent: Sep. 5, 2023

(54) GOLF BALL PICKUP TOOL

(71) Applicant: S.T.O Ltd, Mishima (JP)

(72) Inventor: Katsuyuki Sakakura, Mishima (JP)

(73) Assignee: S.T.O Ltd, Mishima (JP)

( * ) Notice: Subject to any disclaimer, the term of this patent is extended or adjusted under 35 U.S.C. 154(b) by 553 days.

(21) Appl. No.: 16/970,701

(22) PCT Filed: Jul. 30, 2019

(86) PCT No.: PCT/JP2019/029876
§ 371 (c)(1),
(2) Date: Aug. 18, 2020

(87) PCT Pub. No.: WO2021/019694
PCT Pub. Date: Feb. 4, 2021

(65) Prior Publication Data
US 2023/0173348 A1 Jun. 8, 2023

(51) Int. Cl.
*A63B 47/02* (2006.01)
*A63B 57/20* (2015.01)

(52) U.S. Cl.
CPC ..... *A63B 47/02* (2013.01); *A63B 57/20* (2015.10)

(58) Field of Classification Search
CPC ..... A63B 47/02; A63B 57/20
See application file for complete search history.

(56) References Cited

U.S. PATENT DOCUMENTS

| | | | | | |
|---|---|---|---|---|---|
| 1,658,145 | A * | 2/1928 | Uyei | A63B 47/02 | 294/166 |
| 1,723,091 | A * | 8/1929 | St John | A63B 47/02 | D21/721 |
| 3,038,751 | A * | 6/1962 | Stafford | A63B 47/02 | 294/19.2 |
| 3,318,628 | A * | 5/1967 | White | A63B 60/16 | D21/721 |
| 5,004,240 | A * | 4/1991 | Tsukamoto | A63B 53/007 | 473/286 |
| 5,335,953 | A * | 8/1994 | Luther, Sr. | A63B 47/02 | 294/99.1 |
| 7,713,136 | B1 * | 5/2010 | Colucci | A63B 47/02 | 473/286 |
| 2006/0073904 | A1 | 4/2006 | Novak | | |
| 2018/0242732 | A1 * | 8/2018 | Smalligan | A63B 55/408 | |

FOREIGN PATENT DOCUMENTS

| | | | |
|---|---|---|---|
| JP | 04-037466 | U | 3/1992 |
| JP | 3110281 | U | 6/2005 |
| JP | 3175271 | U | 4/2012 |
| WO | 2008/033736 | A2 | 3/2008 |

* cited by examiner

*Primary Examiner* — Stephen A Vu
(74) *Attorney, Agent, or Firm* — Sughrue Mion, PLLC

(57) ABSTRACT

A golf ball pickup tool is provided. The golf ball pickup tool can be extended to an appropriate length when picking up a golf ball and can be shortened when carrying. The grip 10 is sized so as to accommodate holder pieces 11*a* and 11*b* that are slidable along the slide guide 17. The holder pieces 11*a* and 11 b are joined and fixed to each other at one ends thereof and are urged so as to close the other ends. A golf ball is held between the other ends of the holder pieces 11*a* and 11*b* in the state of the holder pieces 11*a* and 11*b* being taken out of the grip 10.

10 Claims, 7 Drawing Sheets

GOLF BALL PICKUP TOOL

CROSS REFERENCE TO RELATED APPLICATIONS

This application is a National Stage of International Application No. PCT/JP2019/029876 filed Jul. 30, 2019.

TECHNICAL FIELD

The present disclosure relates to a golf ball pickup tool to be used to pick up a golf ball.

BACKGROUND ART

The conventional rules of golf stipulated that a flagstick (pin) is to be removed from a cup on the green when a golf ball enters the cup. Revised rules, however, allow players to play with the pin left in the cup.

The cup is required to have a diameter of 108 mm and a depth of 101.6 mm or more. It is recommended in Japan that the pin have a length of 2.13 m or more. The diameter of the pin is not regulated. In general, an appropriate diameter suitable for the pin having such a length is used to provide sufficient strength.

In the state of the pin remaining in the above-sized cup, when a golf ball having a diameter of 42.67 mm or more is in the cup, a player, especially a male player with large hands may have difficulty to take the ball out of the cup by hand. When the player put a hand in the cup, the player may have a scratch on a finger or the back of the hand.

To address this problem, a pickup tool for picking up a golf ball without a hand being put inside the cup has been proposed (for example, see PTL 1).

The pickup tool includes an elastic holder for holding a golf ball and a band for attaching the elastic holder to a grip end of a golf club. The elastic holder is formed of a pair of ring portions disposed so as to oppose each other. The ring portions are formed of a stainless steel wire into a ring-like shape. The ring portions disposed opposingly are connected to each other by a connection portion disposed between the ring portions.

The connection portion has elasticity for urging the ring portions to be parted. The connection portion is fixed to the band by using an adhesive or by stitching.

The band is formed of a belt-like elastic member into an annular shape and is detachably attached to the grip end of a golf club.

When using the pickup tool, a user attaches the band to the grip end of a golf club and inserts the ring portion that protrudes from the grip end into a cup.

When the ring portion is inserted further toward the bottom of the cup, the ring portion abuts a golf ball in the cup and the golf ball presses the paired ring portions to open. The golf ball is thereby held by the ring portions.

In this state, the golf ball is taken out of the cup by pulling the grip end upward.

CITATION LIST

Patent Literature

[PTL 1] Japanese Registered Utility Model No. 3110281

SUMMARY OF INVENTION

Technical Problem

Since the known golf ball pickup tool is configured in such a manner, it is necessary to attach the golf ball pickup tool to a golf club when picking up a ball from the cup or to detach the golf ball pickup tool from the golf club when hitting a ball with the golf club.

In other words, it requires attaching and detaching of the golf ball pickup tool frequently while moving around in a golf course or during playing golf. Moreover, for example, a user may leave (store) the golf ball pickup tool somewhere after removed from the golf club and may forget where to put.

Moreover, in order to pick up the golf ball from the cup with a comfortable posture, the golf ball pickup tool may be required, for example, to have a long handle. However, a long pickup tool suitable for picking up a ball easily may not be convenient to carry during playing golf.

The present disclosure, which is made to address the above problem, provides a golf ball pickup tool that can be extended to an appropriate length when picking up a golf ball and can be shortened when carrying.

Solution to Problem

A golf ball pickup tool according to the present disclosure includes an elongated grip configured to be grabbed by hand and two holder pieces that are made of a material having spring properties and configured to hold a golf ball therebetween. In the golf ball pickup tool, the grip has a movable support that movably supports the two holder pieces in a predetermined moving direction, and the grip is sized so as to accommodate the two holder pieces supported by the movable support. In addition, base ends of the two holder pieces are joined to each other and supported by the movable support, and the two holder pieces are urged so as to close distal ends of the two holder pieces. Moreover, the golf ball is held between the distal ends in the state of the two holder pieces being extended from the grip by moving the two holder pieces accommodated in the grip in the moving direction of the two holder pieces at the movable support.

Advantageous Effects of Invention

According to the present disclosure, due to the total length being adjustable, the golf ball pickup tool is convenient to carry and enables a user to pick up a golf ball with a comfortable posture.

DESCRIPTION OF EMBODIMENTS

A golf ball pickup tool according to the present disclosure is formed of two holder pieces that have spring properties. The golf ball pickup tool is configured such that a grip has a movable support that movably supports the two holder pieces so as to enable the two holder pieces to be accommodated in the grip.

One ends of the two holder pieces are joined to each other and supported by the movable support. The two holder pieces are urged so as to close the other ends of the two holder pieces. A golf ball is to be held by the urged other ends.

The movable support is a slide guide that enables the two holder pieces to slide in the longitudinal direction of the grip or is a rotatable support that enables the two holder pieces to turn on a pivot located near one longitudinal end of the grip.

The grip has a clip with which the golf ball pickup tool is attached to an equipment item.

Each holder piece has a holding hole formed near the distal end of the other end, and the golf ball is to be inserted into the holding hole. The diameter of the holding hole is smaller than that of the golf ball.

The holding hole is shaped substantially like an oval. Accordingly, when the golf ball is held between the other ends of the two holder pieces while portions of the golf ball are inserted into respective holding holes, the two holder pieces are bent like bows.

The two holder pieces are warped outward near the other ends in such a manner that the other ends open when two holder pieces are put together.

The two holder pieces are bent sharply at the other ends in such a manner that the end portions open when two holder pieces are put together.

Now, an embodiment of the present invention will be described.

First Embodiment

Figure 1:
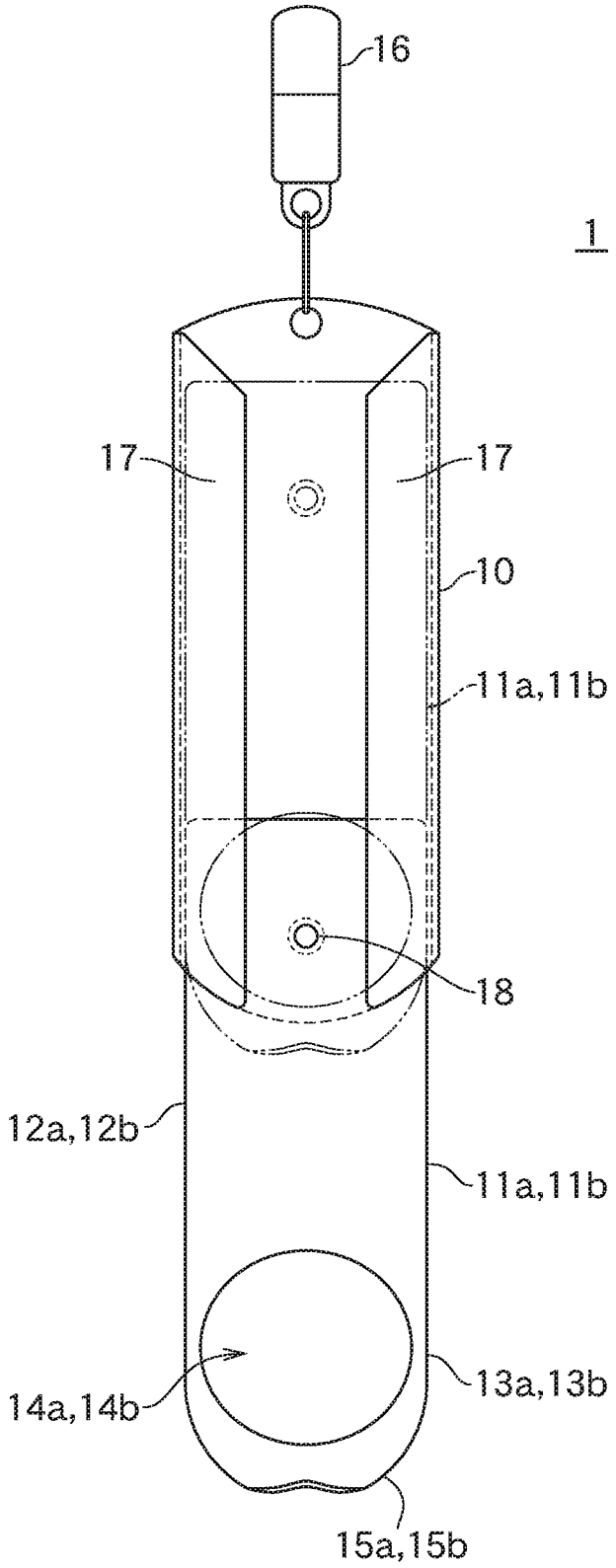
FIG. 1 is an explanatory drawing illustrating a configuration of a golf ball pickup tool according to First Embodiment of the present disclosure.
Figure 2:
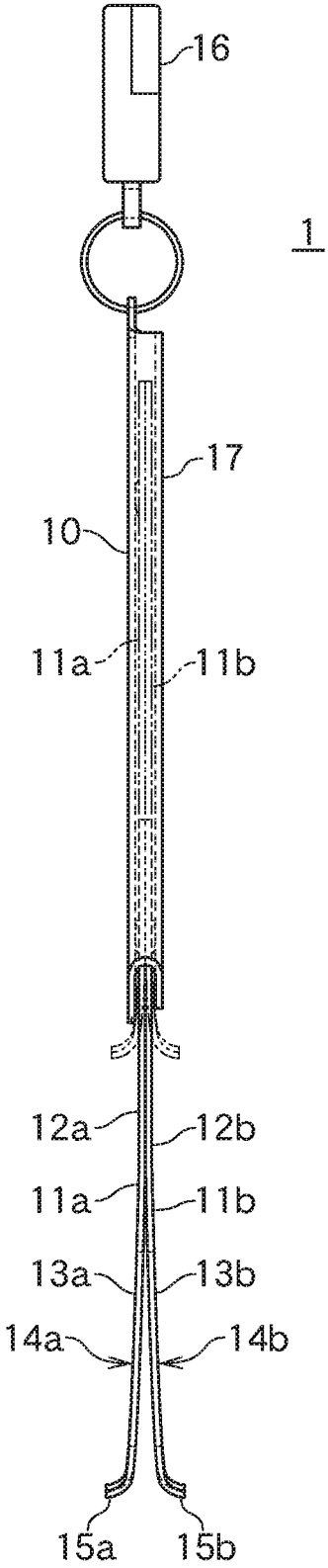
FIG. 2 is an explanatory drawing illustrating the configuration of the golf ball pickup tool of FIG. 1 as viewed sideways.

FIG. 1 is a n illustrating a configuration of a pickup tool 1 according to first Embodiment of the present disclosure. FIG. 1 illustrates a configuration of the pickup tool 1 when a holding hole 14*a* and a holding hole 14*b*, which come into contact with a golf ball, are viewed from in front. FIG. 2 is an explanatory drawing illustrating the configuration of the pickup tool 1 of FIG. 1 as viewed sideways.

The pickup tool 1 includes a grip 10, holder pieces 11*a* and 11*b*, and a clip 16 or the like. The grip 10 is elongated such that the grip 10 can be grasped by the palm of a hand. The holder pieces 11*a* and 11*b* are formed so as to be able to hold a golf ball at ends of the holder pieces. The clip 16 and other components are used when the pickup tool 1 is detachably attached to an equipment item, such as a putter cover or a user's belt.

The grip 10 is made of a rigid material that does not deform, for example, by grasping by hand. For example, a metal or hard resin plate is shaped appropriately so as to have a length that enables the holder pieces 11*a* and 11*b* to be accommodated therein.

In addition, the grip 10 includes a slide guide 17 (movable support) that supports the holder pieces 11*a* and 11*b* and enables the holder pieces 11*a* and 11*b* to slide in the longitudinal direction of the grip 10.

The slide guide 17 is formed by bending both of longitudinally extending edge portions of the grip 10 toward one side in such a manner that the longitudinal edge portions hold and support the holder pieces 11*a* and 11*b* (with spaces interposed therebetween so as to enable sliding).

For example, the slide guide 17 may have a positioning mechanism, such as a latch mechanism, that enables the holder pieces 11*a* and 11*b* to be anchored at a position indicated by the solid lines in FIGS. 1 and 2 or at a position indicated by the dash-dot-dot lines.

The holder pieces 11*a* and 11*b* are overlaid on each other, and portions of the holder pieces 11*a* and 11*b* near one ends (base ends) thereof are joined to each other using, for example, an adhesive.

The holder pieces 11*a* and 11*b* are formed by a thin plate made of a metal or a resin having spring properties. Overlaying the holder pieces 11*a* and 11*b* and joining respective one ends (base ends) thereof urges the other ends (distal ends) to close.

The holder pieces 11*a* and 11*b* are formed so as to have substantially the same shapes (so as to be symmetric in the thickness direction when the holder pieces 11*a* and 11*b* are overlaid on each other).

In other words, an arm 12*b* has a shape similar to that of an arm 12*a*, and a holding portion 13*b* has a shape similar to that of a holding portion 13*a*.

A holding hole 14*b* has a shape similar to that of a holding hole 14*a*, and a distal end portion 15*b* has a shape similar to that of a distal end portion 15*a*.

Here, the configuration of the holder pieces will be described further by taking the holder piece 11*a* as an example.

The holder piece 11*a* includes the arm 12*a* that comes into contact with the slide guide 17 of the grip 10 and the holding portion 13*a* having the holding hole 14*a* formed therein. The holding hole 14*a* comes into contact with a golf ball to be picked up (in other words, accommodates a portion of the golf ball therein).

The holding portion 13*a* is a portion that extends from the arm 12*a* and is positioned closer to the other end (the distal end) of the holder piece 11*a*.

The holding portion 13*a* is not a portion to be joined by an adhesive and can bend easily. A portion of the holding portion 13*a* near the distal end is slightly warped outward. In other words, the holder piece 11*a* and the holder piece 11*b* are formed in such a manner that when the holder piece 11*a* and the holder piece 11*b* are overlaid on each other, the distal end portions of the holder pieces 11*a* and 11*b* open.

The holding hole 14*a* is a through hole that is formed near the distal end of the holding portion 13*a* (near the warped portion) and has a diameter smaller than that of the golf ball. The shape of the holding hole 14*a* is not a perfect circle but is like, for example, an oval having the major axis aligned in the width direction of the holder piece 11*a*.

More specifically, the holding hole 14*a* is shaped substantially like an oval, and the holder pieces 11*a* and 11*b* (holding portions 13*a* and 13*b*) with their distal end portions opening are bent like bows when a portion of a golf ball 2 enters the holding hole 14*a* and another portion of the golf ball 2 enters the holding hole 14*b* and the golf ball 2 is thus held between the holder pieces 11*a* and 11*b*, in other words, between the holding portions 13*a* and 13*b*.

Due to the holder pieces 11*a* and 11*b* (holding portions 13*a* and 13*b*) being bent like bows, the holder pieces 11*a* and 11*b* can be urged strongly against the golf ball 2 (i.e., can hold the golf ball 2 tightly).

Note that the holding holes 14*a* and 14*b* may be formed into a heart-like shape having a function similar to that of the oval described above. For example, the heart-like shape has dimensions substantially equal to the major axis and the minor axis of the oval.

The distal end portion 15*a* of the holder piece 11*a*, or of the holding portion 13*a*, is bent approximately by 90 degrees. When the holder piece 11*a* and the holder piece 11*b* are overlaid on each other, the distal end portions are bent in the directions of opening the distal end portions.

More specifically, the distal end portions 15*a* and 15*b* are bent into such shapes that enables a golf ball 2 to be moved (guided) to a position between the distal end portions 15*a* and 15*b* when the spherical surface of a golf ball 2 comes into contact with one or both of the distal end portions 15*a* and 15*b* in the state in which the holder pieces 11*a* and 11*b* are overlaid on each other and supported by the slide guide 17.

A protrusion 18 is disposed, for example, on the holder piece 11*b* in the case in which the holder piece 11*b* is exposed from the slide guide 17 when the holder pieces 11*a* and 11*b* are overlaid on each other and the base ends of the holder pieces 11*a* and 11*b* are supported by the slide guide 17.

The protrusion 18 is disposed, for example, at an appropriate position of the arm 12*b*. The protrusion 18 is exposed there, in other words, is not covered with the slide guide 17. The protrusion 18 protrudes outward from the grip 10.

The protrusion 18 is formed in such a size that a finger can be placed thereon for sliding the holder pieces 11*a* and 11*b*.

The holder pieces 11*a* and 11*b* supported by the slide guide 17 are disposed in the grip 10 so as to be able to slide between a position indicated by the solid line and a position indicated by the dash-dot-dot line in FIGS. 1 and 2.

When the holder pieces 11*a* and 11*b* are slid along the slide guide 17 to the position indicated by the dash-dot-dot line, the distal end portions 15*a* and 15*b* of the holder pieces 11*a* and 11*b* and their vicinities protrude slightly from the distal end portion of the grip 10. In other words, the grip 10 has such dimensions (length, width, thickness) that the holder pieces 11*a* and 11*b* can be substantially accommodated therein.

In the case of the pickup tool 1 being carried, the total length of the pickup tool 1 is reduced by sliding the holder pieces 11*a* and 11*b* into the grip 10, in other words, by disposing the holder pieces 11*a* and 11*b* at the position indicated by the dash-dot-dot line.

The clip 16 is disposed at a rear end of the grip 10 (at a longitudinal end of the grip 10 that is opposite to the distal end portion of the grip 10 at which the distal end portions 15*a* and 15*b* protrude).

In the case of the pickup tool 1 being carried, the pickup tool 1 is shortened as described above and attached, for example, to an equipment item, such as a putter cover, by using the clip 16.

Figure 3:
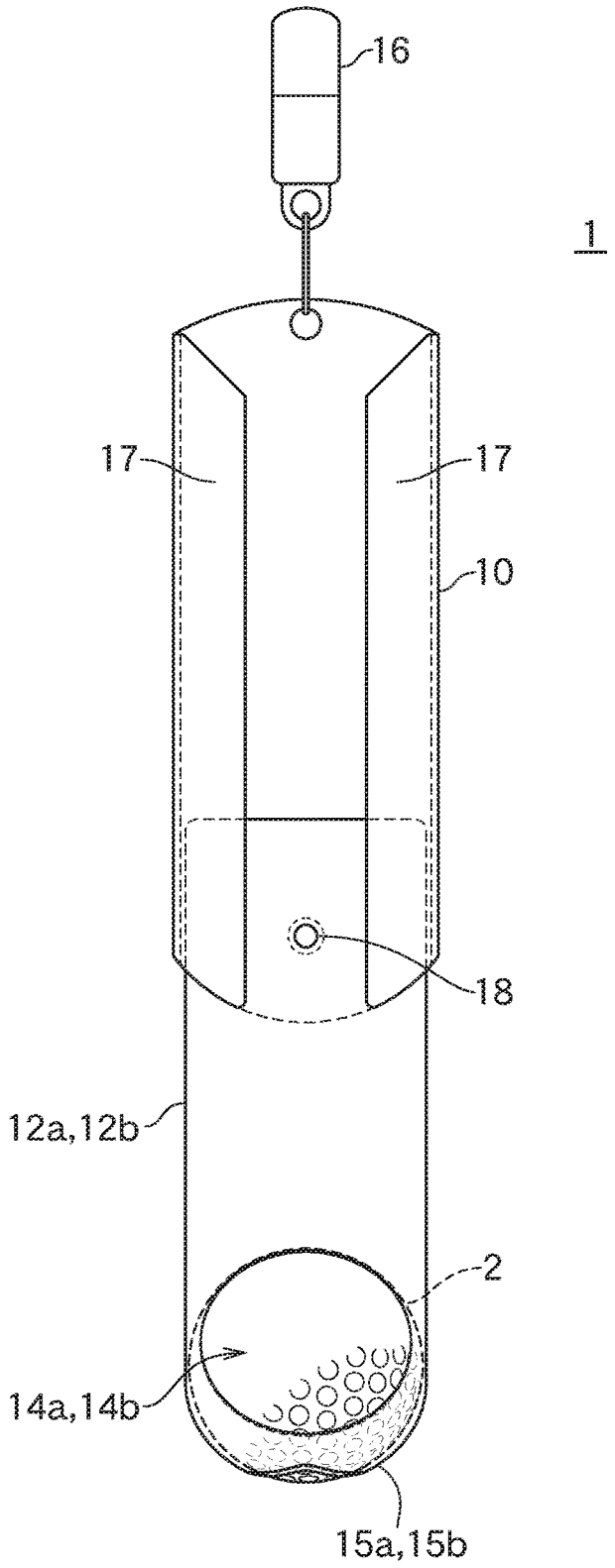
FIG. 3 is an explanatory drawing illustrating the golf ball pickup tool of First 1 when the golf ball pickup tool holds a golf ball.
Figure 4:
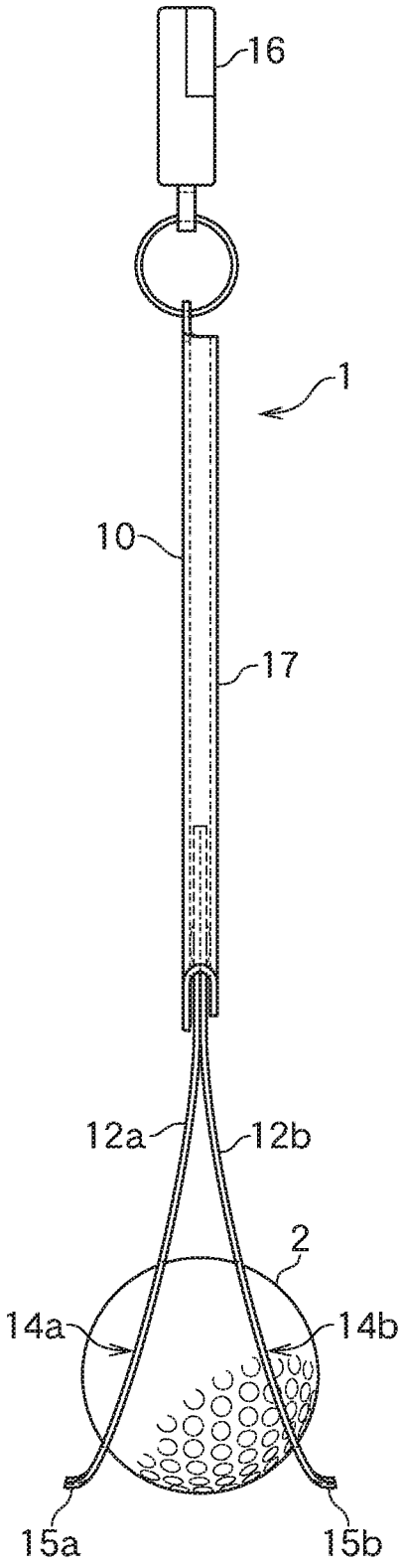
FIG. 4 is an explanatory drawing illustrating the golf ball pickup tool of FIG. 3 as viewed sideways when the golf ball pickup tool holds a golf ball.

FIG. 3 is an explanatory drawing illustrating the pickup tool 1 when the pickup tool 1 holds the golf ball 2. FIG. 4 is a n illustrating the pickup tool 1 of FIG. 3 as viewed sideways when the pickup tool 1 holds the golf ball 2.

For example, when the golf ball 2 is held by the pickup tool 1, the holder pieces 11*a* and 11*b* are first slid along the slide guide 17, and the arms 12*a* and 12*b* are pulled out from the distal end portion of the grip 10 to enable the holding portions 13*a* and 13*b* to bend freely. In other words, the pickup tool 1 assumes the state in which the holder pieces 11*a* and 11*b* are extended from the grip 10 to their full length.

While the holding portions 13*a* and 13*b* and other portions bend, one portion of the golf ball 2 is allowed to enter the holding hole 14*a*, and another portion thereof (a portion located approximately opposite to the one portion) is allowed to enter the holding hole 14*b*.

When the golf ball 2 enters the holding holes 14*a* and 14*b*, respective distal end portions of the holder pieces 11*a* and 11*b* open, and urging forces that act on the golf ball 2 in two opposing directions toward the center thereof are generated by the holding portions 13*a* and 13*b* and other portions that are bent like bows.

In other words, forces for holding the opposite sides of the golf ball 2 are generated so as to stabilize the golf ball 2 between the holder pieces 11*a* and 11*b*.

Figure 5:
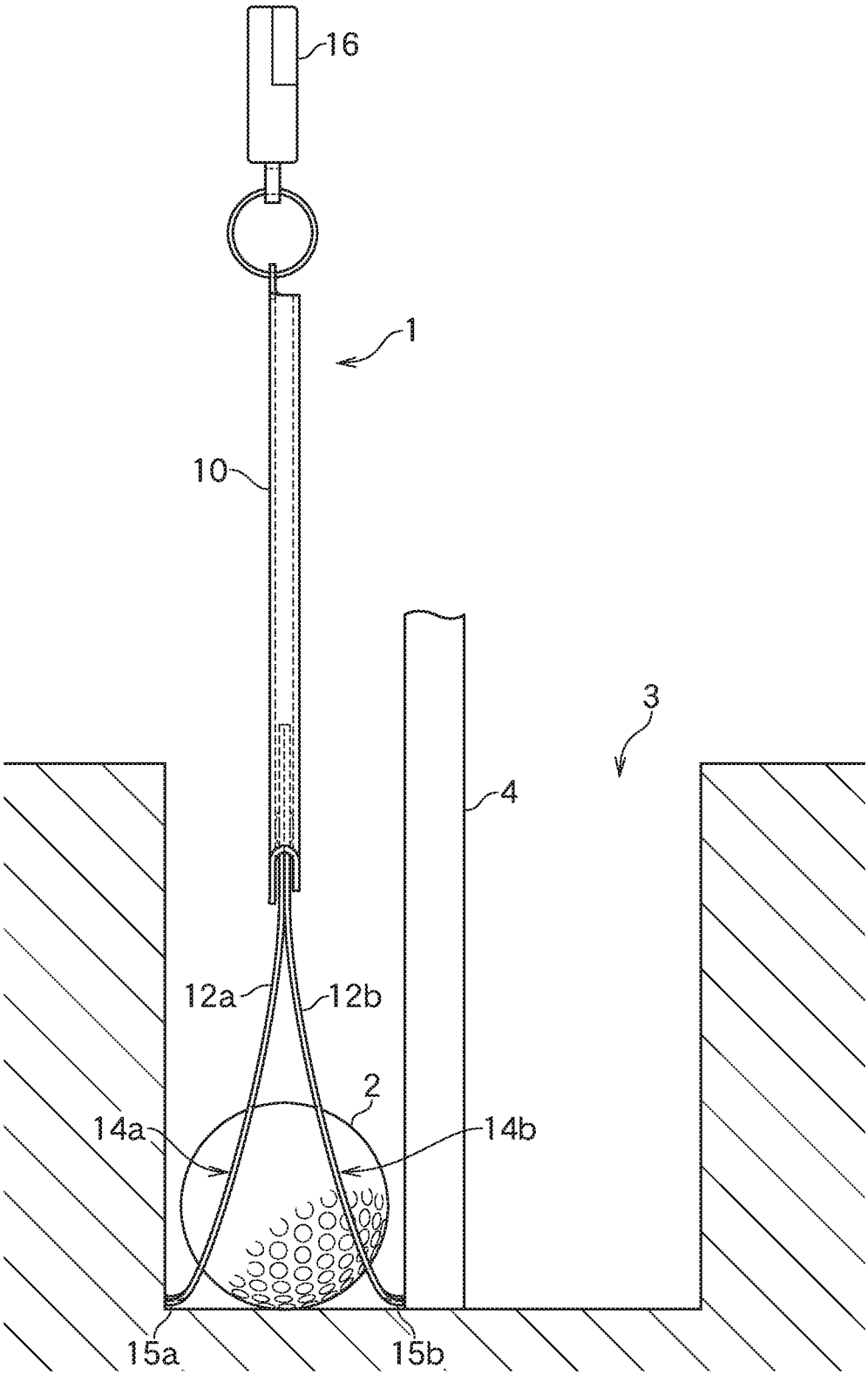
FIG. 5 is an explanatory drawing illustrating a state in which a golf ball is picked up from a cup with the golf ball pickup tool of First Embodiment.

FIG. 5 is an explanatory drawing illustrating a state in which the golf ball 2 is picked up from a cup 3 with the pickup tool 1. This figure illustrates a cross section of the cup 3 on the green of golf course. The golf ball 2 inside the cup 3 is picked up with the pickup tool 1 while a pin 4 is in the cup 3.

When the golf ball 2 is picked up from the cup 3, the holder pieces 11*a* and 11*b* are first pulled out of the grip 10. In this state, portions of the holder pieces 11*a* and 11*b* on a side closer to the distal ends, in other words, the holding portions 13*a* and 13*b* and the like can bend easily.

The pickup tool 1 in this state is subsequently inserted in the cup 3 (with the distal ends of the holder pieces 11*a* and 11*b* entering first), and the holding portions 13*a* and 13*b*, or the distal end portions 15*a* and 15*b*, come into contact with a top part of the golf ball 2 in the cup 3.

When the pickup tool 1 is inserted further toward the bottom of the cup 3, the golf ball 2 is guided to a position between the distal end portions 15*a* and 15*b* that are bent as described above. The golf ball 2 comes into contact with the distal end portions 15*a* and 15*b*, which causes the distal end portions 15*a* and 15*b* to open. The golf ball 2 is inserted between the distal end portions 15*a* and 15*b* that are open in such a way, in other words, inserted between the holding portions 13*a* and 13*b*. A portion of the golf ball 2 enters the holding hole 14*a*, while another portion of the golf ball 2 enters the holding hole 14*b*.

When the holding holes 14*a* and 14*b* accommodate respective portions of the golf ball 2, the holding portions 13*a* and 13*b* and the like are bent like bows, and the golf ball 2 is held by urging forces generated by the holding portions 13*a* and 13*b* and the like.

In this state, the pickup tool 1 or the holder pieces 11*a* and 11*b* are pulled out upward to take the golf ball 2 out of the cup 3.

According to Example 1, as described above, the pickup tool 1 is configured such that the holder pieces 11*a* and 11*b* are stored in the grip 10 by sliding the holder pieces 11*a* and 11*b*. In the case of the pickup tool 1 being carried, for example, the total length of the pickup tool 1 can be reduced, and the pickup tool 1 can be attached to an equipment item easily, which can reduce the likelihood of the pickup tool 1 disturbing golfing or being lost.

In addition, bendable holder pieces 11*a* and 11*b* are stored in the grip 10, which prevents the holder pieces 11*a* and 11*b* from bending excessively or from being twisted.

The pickup tool 1 described above includes the slide guide 17 and is configured to accommodate the holder pieces 11*a* and 11*b* in the grip 10. The golf ball pickup tool, however, may be configured such that the grip 10 does not include the slide guide 17 and the holder pieces 11*a* and 11*b* are joined and fixed to the grip 10 thereby maintaining the state of the holder pieces 11*a* and 11*b* extending from the grip 10.

In addition, the holder pieces 11*a* and 11*b* of the pickup tool 1 are formed as thin plates. The pickup tool 1, however, may be configured, for example, to have two holder pieces that are formed of a wire material having spring properties and also configured to have a function similar to that of the above-described holder pieces 11*a* and 11*b*.

Second Embodiment

Figure 6:
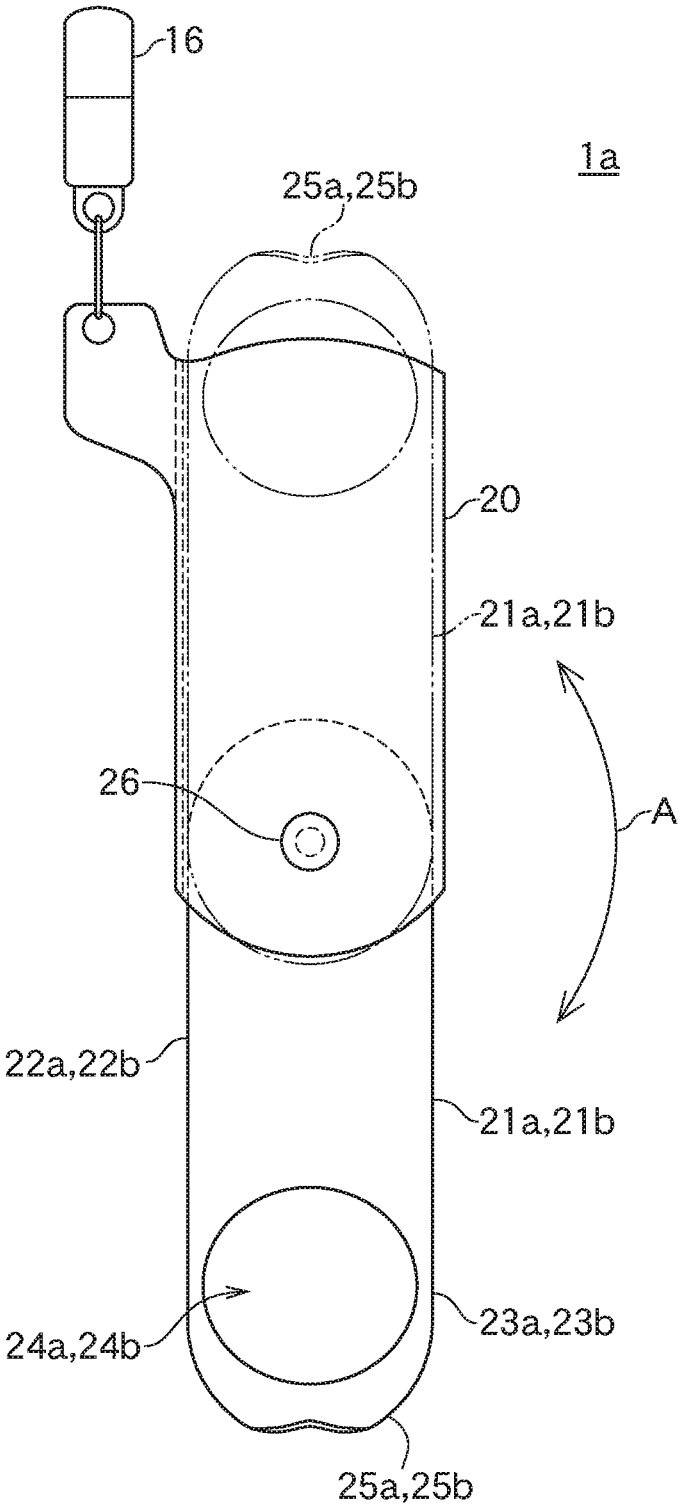
FIG. 6 is an explanatory drawing illustrating a configuration of a golf ball pickup tool according to second Embodiment of the present disclosure.
Figure 7:
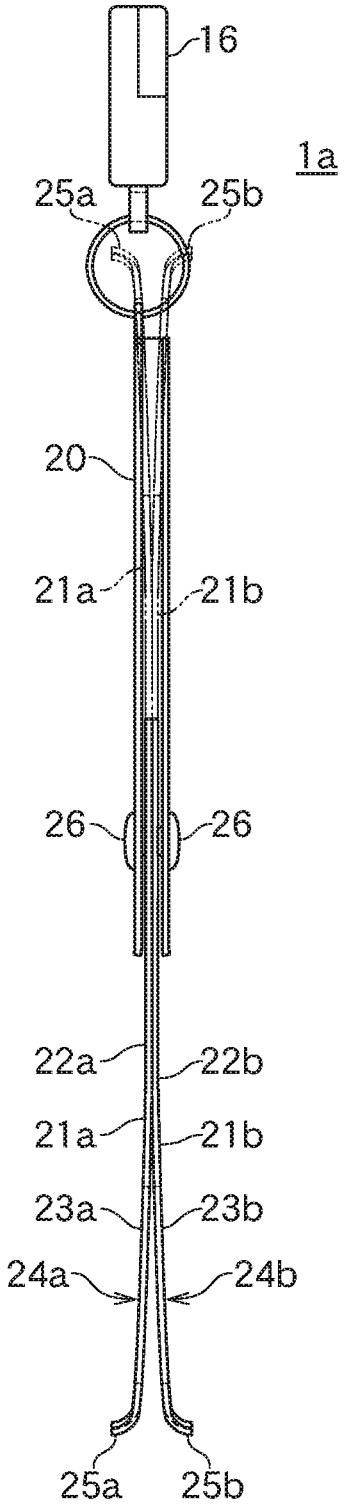
FIG. 7 is an explanatory drawing illustrating the configuration of the golf ball pickup tool of FIG. 6 as viewed sideways.

FIG. 6 is an explanatory drawing illustrating a configuration of a pickup tool 1*a* according to Example 2 of the present disclosure. FIG. 6 illustrates the configuration of the pickup tool 1*a* by way of example when holding holes 24, which come into contact with the golf ball 2 (not illustrated), are viewed from in front. FIG. 7 is an explanatory drawing illustrating the configuration of the pickup tool 1*a* of FIG. 6 as viewed sideways.

The pickup tool 1*a* includes a grip 20, holder pieces 21*a* and 21*b*, and the clip 16. The grip 20 can be grasped by the palm of a hand. The holder pieces 21*a* and 21*b* are formed so as to be supported by the grip 20 and so as to hold the golf ball 2 between end portions of the holder pieces. The clip 16 and other components are used when the pickup tool 1*a* is detachably attached to an equipment item, such as a putter cover or a user's belt.

The grip 20 is made of a material similar to that of the grip 10. The grip 20 has such a length that the holder pieces 21*a* and 21*b* can be accommodated at a position of the holder pieces 21*a* and 21*b* indicated by the dash-dot-dot line in FIGS. 6 and 7.

The grip 20 has a slit in the thickness-wise portion of the grip 20 and is formed so as to accommodate the holder pieces 21*a* and 21*b* therein.

More specifically, for example, the grip 20 is formed by overlaying two plate-like members on each other and joining respective parts of the two plate-like members together so as to provide a slit between the two plate-like members for accommodating the holder pieces 21*a* and 21*b*.

The grip 20 includes a rotatable support 26 (movable support) that rotatably supports base end portions of the holder pieces 21*a* and 21*b* indicated by the dashed line in FIG. 6.

In other words, the rotatable support 26 is fixed, for example, to a distal end portion (one end portion) of the grip 20, which is positioned near the base ends of the holder pieces 21*a* and 21*b*.

In the rotatable support 26, the rotation axis is disposed parallel to the thickness direction of the grip 20 (in the thickness direction). In other words, the rotation axis is disposed so as to orthogonally intersect the principal surfaces of the grip 20.

The holder pieces 21*a* and 21*b* are made of a material similar to that of the holder pieces 11*a* and 11*b* and have respective arms 22*a* and 22*b* that correspond to the arms 12*a* and 12*b* and respective distal end portions 25*a* and 25*b* that correspond to the distal end portions 15*a* and 15*b*.

The holder pieces 21*a* and 21*b* also have respective holding portions 23*a* and 23*b* that are similar to the holding portions 13*a* and 13*b*. Holding holes 24*a* and 24*b*, which are shaped similarly to the holding holes 14*a* and 14*b*, are formed in respective holding portions 23*a* and 23*b*. In other words, the holding holes 24*a* and 24*b* are shaped substantially like ovals as are the holding holes 14*a* and 14*b*. The holding holes 24*a* and 24*b* may be formed into heart-like shapes.

The holder pieces 21*a* and 21*b* are supported by the grip 20 with the rotatable support 26 and are rotatable, for example, in the direction indicated by the arrow A (in both directions) in FIG. 6.

The clip 16 of the grip 20 is disposed so as not to interfere with rotation of the holder pieces 21*a* and 21*b*.

In the case of the pickup tool 1*a* being carried, for example, the holder pieces 21*a* and 21*b* are turned toward the grip 20 and moved to a position indicated by the dash-dot-dot line, for example, in FIG. 6, etc. The holder pieces 21*a* and 21*b* are moved to the position indicated by the dash-dot-dot line and accommodated in the grip 20, which reduces the total length of the pickup tool 1*a*.

In the pickup tool 1*a* exemplified here, when the holder pieces 21*a* and 21*b* are accommodated in the grip 20, the distal end portions of the holding portions 23*a* and 23*b* (which are portions warped outward) are exposed at the rear end of the grip 20 (an end where the clip 16 is disposed).

For example, when the golf ball 2 is picked up using the pickup tool 1*a*, the holder pieces 21*a* and 21*b* accommodated in the grip 20 are turned to a position at which the holder pieces 21*a* and 21*b* are aligned in a straight line with the grip 20, in other words, to a position at which the holder pieces 21*a* and 21*b* are extended from the grip 20, which increases the total length of the pickup tool 1*a*.

When the total length of the pickup tool 1*a* is increased as above, the golf ball 2 can be held between the holder piece 21*a* and the holder piece 21*b* as is the case for Example 1 (pickup tool 1). In other words, the holding portions 23*a* and 23*b* are bent like bows, and respective portions of the golf ball 2 enter the holding holes 24*a* and 24*b*, thereby enabling the golf ball 2 to be picked up.

According to Example 2, as described above, the pickup tool 1*a* is configured such that the holder pieces 21*a* and 21*b* are stored in the grip 20 by turning the holder pieces 21*a* and 21*b*. In the case of the pickup tool 1*a* being carried, for example, the total length of the pickup tool 1*a* can be reduced and the pickup tool 1*a* can be attached to an equipment item easily, which can reduce the likelihood of the pickup tool 1*a* disturbing golfing or being lost.

In addition, bendable holder pieces 21*a* and 21*b* can be stored in the grip 20, which prevents the holder pieces 21*a* and 21*b* from bending excessively or from being twisted.

REFERENCE SIGNS LIST

1, 1*a* pickup tool
2 golf ball
3 cup
4 pin
10 grip
11*a*, 11*b*, 21*a*, 21*b* holder piece
12*a*, 12*b*, 22*a*, 22*b* arm
13*a*, 13*b*, 23*a*, 23*b* holding portion
14*a*, 14*b*, 24*a*, 24*b* holding hole
15*a*, 15*b*, 25*a*, 25*b* distal end portion
16 clip
17 slide guide
18 protrusion
26 rotatable support

The invention claimed is:

1. A golf ball pickup tool comprising:

an elongated grip configured to be grabbed by hand; and two holder pieces that are made of a material having spring properties and configured to hold a golf ball therebetween, wherein the grip has a movable support that movably supports the two holder pieces in a predetermined moving direction, and the grip is sized so as to accommodate the two holder pieces supported by the movable support, base ends of the two holder pieces are joined to each other and supported by the movable support, and the two holder pieces are urged so as to close distal ends of the two holder pieces, the movable support is a rotatable support configured to turn the two holder pieces on a pivot located near one longitudinal end of the grip, and the golf ball is held between the distal ends in the state of the two holder pieces being extended from the grip by turning the two holder pieces accommodated in the grip out of the grip, wherein each of the two holder pieces is formed of a thin plate material into a shape having an arm and has a holding hole formed at a position closer than the arm to the distal end, the holding hole being configured to receive and hold the golf ball inserted therein, and the base ends of the two holder pieces that are overlaid on each other are joined to each other.

2. The golf ball pickup tool according to claim 1, wherein the holding holes have respective diameters smaller than that of the golf ball.

3. The golf ball pickup tool according to claim 1, wherein when the two holder pieces are overlaid on each other, the two holder pieces are warped outward so as to open the distal ends of the two holder pieces.

4. The golf ball pickup tool according to claim 1, wherein the distal ends of the two holder pieces are bent sharply in directions of opening the two holder pieces that are overlaid on each other.

5. The golf ball pickup tool according to claim 1, wherein the grip has a clip with which the golf ball pickup tool is attached to an equipment item.

6. A golf ball pickup tool comprising:

an elongated grip configured to be grabbed by hand; and two holder pieces each of which is formed of a thin plate material having spring properties into a shape having an arm and each of which has a holding hole formed at a position closer than the arm to a distal end of each of the two holder pieces, the two holder pieces being configured to hold the golf ball that are inserted into respective holder holes, wherein the grip has a movable support that movably supports the two holder pieces in a predetermined moving direction, and the grip is sized so as to accommodate the two holder pieces supported by the movable support, base ends of the two holder pieces that are overlaid on each other are joined and supported by the movable support, and the two holder pieces overlaid are urged so as to close the distal ends of the two holder pieces, and the golf ball inserted in respective holding holes of the two holder pieces is held between the distal ends in the state of the two holder pieces being extended from the grip by moving the two holder pieces accommodated in the grip while the two holder pieces being supported by the movable support, wherein the movable support is a slide guide configured to enable the two holder pieces to slide in a longitudinal direction of the grip while the slide guide being in contact with the arm, and the two holder pieces hold the golf ball in the state of the two holder pieces being extended from the grip by sliding the two holder pieces along the slide guide.

7. The golf ball pickup tool according to claim 6, wherein the grip has a clip with which the golf ball pickup tool is attached to an equipment item.

8. The golf ball pickup tool according to claim 6, wherein the holding holes have respective diameters smaller than that of the golf ball.

9. The golf ball pickup tool according to claim 6, wherein when the two holder pieces are overlaid on each other, the two holder pieces are warped outward so as to open the distal ends of the two holder pieces.

10. The golf ball pickup tool according to claim 6, wherein the distal ends of the two holder pieces are bent sharply in directions of opening the two holder pieces that are overlaid on each other.

* * * * *